United States Patent [19]

Meador et al.

[11] Patent Number: 4,676,424

[45] Date of Patent: Jun. 30, 1987

[54] NAIL GUIDING AND DRIVING TOOL

[76] Inventors: A. Leon Meador, 2305 Blackiston Mill Rd.; Daniel B. Weber, 2334 Wellington Dr., both of Clarksville, Ind. 47130

[21] Appl. No.: 827,715

[22] Filed: Feb. 10, 1986

[51] Int. Cl.[4] ..... B25C 1/02

[52] U.S. Cl. ..... 227/147

[58] Field of Search ..... 227/113, 147

[56] References Cited

U.S. PATENT DOCUMENTS

| | | | |
|---|---|---|---|
| 1,575,582 | 3/1926 | Joy | 227/147 |
| 1,776,646 | 9/1930 | Wilson | 227/147 |
| 2,588,738 | 3/1952 | Lundgren | 227/147 |
| 2,657,382 | 11/1953 | Luneborg | 227/147 |
| 3,060,440 | 10/1962 | Pfaff et al. | 227/147 |
| 3,147,484 | 9/1964 | Nelson | 227/147 |
| 3,695,499 | 10/1972 | Taylor | 227/147 X |
| 4,029,135 | 6/1977 | Searfoss, Jr. | 145/46 |
| 4,054,237 | 10/1977 | Rietveld | 227/147 |
| 4,179,058 | 12/1979 | Yost | 227/147 |
| 4,403,725 | 9/1983 | Lawrence | 227/147 |
| 4,437,602 | 3/1984 | Kaczmarek | 227/147 |

*Primary Examiner*—Paul A. Bell

*Attorney, Agent, or Firm*—Maurice L. Miller, Jr.

[57] ABSTRACT

A nail guiding and driving tool having a punch slidably disposed within a hollow sleeve. The punch includes a hammer blow receiving body portion containing a pair of relatively large diameter spaced apart end sections which closely fit but slide freely within a large diameter rear end portion of the hollow sleeve joined together by a relatively small diameter mid-section The punch also includes a nail driving portion which closely fits but slides freely within a small diameter forward end portion of the sleeve. A stop pin is connected in a hole in the side of the sleeve and projects into the large diameter portion of the sleeve beyond and between the outer surfaces of the end sections of the body portion at a position along the sleeve wherein a rear end of the forward end section slidably engages the pin to limit rearward sliding motion of the punch within the sleeve but wherein the forward end of the forward end section slides into an annular wall at the joinder of the rear end and forward end portions of the hollow shaft defined by said sleeve to limit forward movement of the punch in said sleeve.

10 Claims, 6 Drawing Figures

FIG. 1
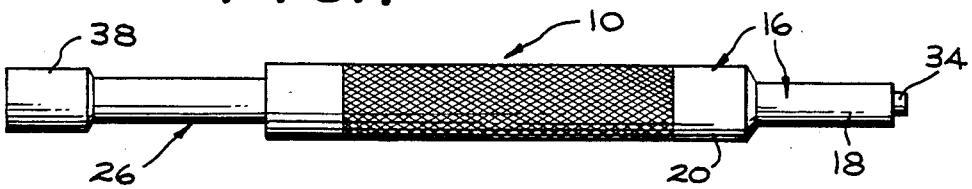
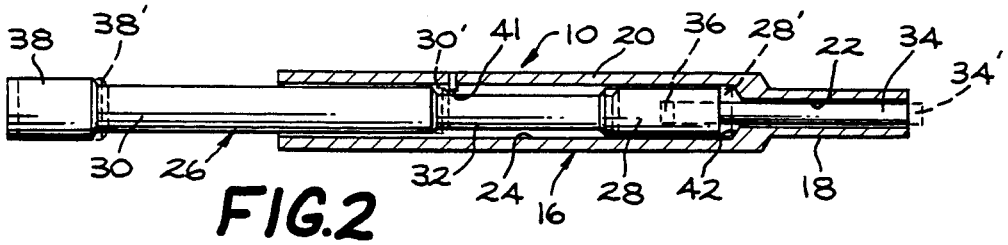
FIG. 2
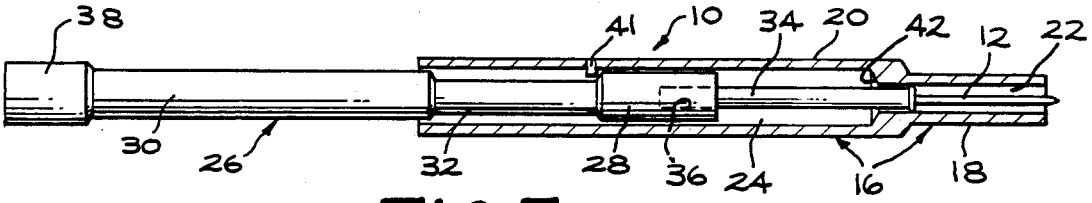
FIG. 3
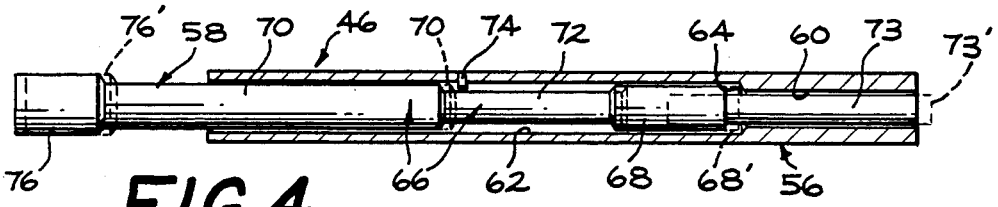
FIG. 4
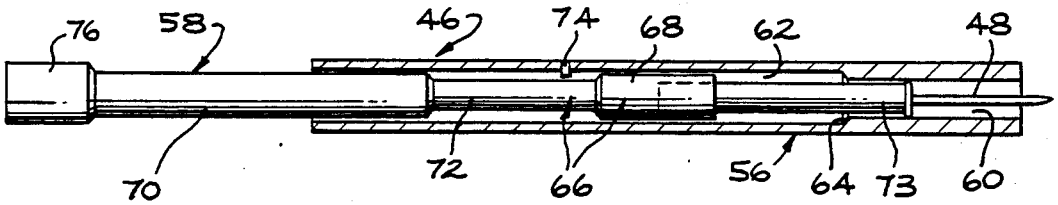
FIG. 5

NAIL GUIDING AND DRIVING TOOL

BACKGROUND OF THE INVENTION

This invention relates generally to hand tools and in particular to nail guiding and driving tools for nailing materials together which are located in hard to reach places.

Various nail guiding and driving tools have long been known and used in the prior art. For example, see the following: U.S. Pat. No. 4,437,602 issued to J. A. Kaczmarek on Mar. 20, 1984; U.S. Pat. No. 4,403,725 issued to N. A. Lawrence on Sept. 13, 1983; U.S. Pat. No. 1,575,582 issued to E. M. Joy on Mar. 2, 1926; U.S. Pat. No. 541,038 issued to D. D. Clark on June 11, 1895; U.S. Pat. No. 2,657,382 issued to W. A. Lueneburg on Nov. 3, 1953; U.S. Pat. No. 3,060,440 issued to E. F. Pfaff, et al. on Oct. 30, 1962; U.S. Pat. No. 4,179,058 issued to N. E. Yost on Dec. 18, 1979; U.S. Pat. No. 3,147,484 issued to P. N. Nelson on Sept. 8, 1964; and U.S. Pat. No. 4,029,135 issued to G. H. Searfoss, Jr. on June 14, 1977.

By means of our invention, we provide a nail guiding and driving tool which is particularly adapted to nail materials such as J-channel soffit trim and gutter hanger, gutter and fascia board as well as materials located in other hard to reach places.

SUMMARY OF THE INVENTION

It is an object of our invention to provide a novel nail guiding and driving tool.

It is a further object of our invention to provide nail guiding and driving tools which are particularly adapted to driving nails into J-channel trim as employed as roof soffit trim and into gutter hanger material, gutters and roof fascia boards.

Briefly, in accordance with our invention, we provide a nail guiding and driving tool which includes a sleeve defining a hollow shaft, punch means slidably disposed partially within the shaft for driving a nail from the sleeve, and stop means connected to the sleeve for limiting the rearward sliding movement of the punch means within the sleeve without interferring with the forward sliding movement of the punch means. The hollow shaft has a lesser diameter forward section opening onto a front end of the sleeve from which a nail can be driven and a larger diameter rearward section opening onto a rear end of the sleeve. The punch means includes a pair of relatively large diameter, spaced apart end sections which closely conform to but which are freely slidable within the rearward shaft section and a relatively small diameter central section which joins the end sections. The punch means also includes a nail driving portion closely conforming to but freely slidable within the forward shaft section joined to the forward most of the end sections for slidable movement of a front end of the nail driving means between a retracted position in a rear end portion of the forward shaft section and an advanced position at least flush with the opening in the front end of the sleeve. Lastly, the stop means projects into the rearward shaft section of the sleeve between the end sections.

These and other objects, features and advantages of our invention will become apparent to those skilled in the art from the following detailed description and the attached drawings upon which, by way of example, only the preferred embodiments of the invention are illustrated and explained.

BRIEF DESCRIPTION OF THE DRAWINGS

FIG. 1 shows a side elevation view along the longitudinal dimension of a nail guide tool, thus illustrating one preferred embodiment of our invention.

FIG. 2 is a side elevation view of the tool of FIG. 1 with a near side of an outer sleeve of said tool torn away to permit viewing of a driving ram or punch of the tool in various forward or advanced positions within the sleeve.

FIG. 3 is a side elevation view of the tool of FIG. 1 with the same near side of the outer sleeve of the tool torn away to permit viewing of the driving ram or punch of the tool in a retracted position within the sleeve.

FIGS. 4–5 show side elevation views along the longitudinal dimension of another nail guide tool, with a near side portion of an outer sleeve of the tool torn away to permit viewing of a driving ram or punch of the tool in advanced and retracted positions, respectively, thus illustrating another preferred embodiment of our invention.

DESCRIPTION OF THE PREFERRED EMBODIMENTS

Figure 6:
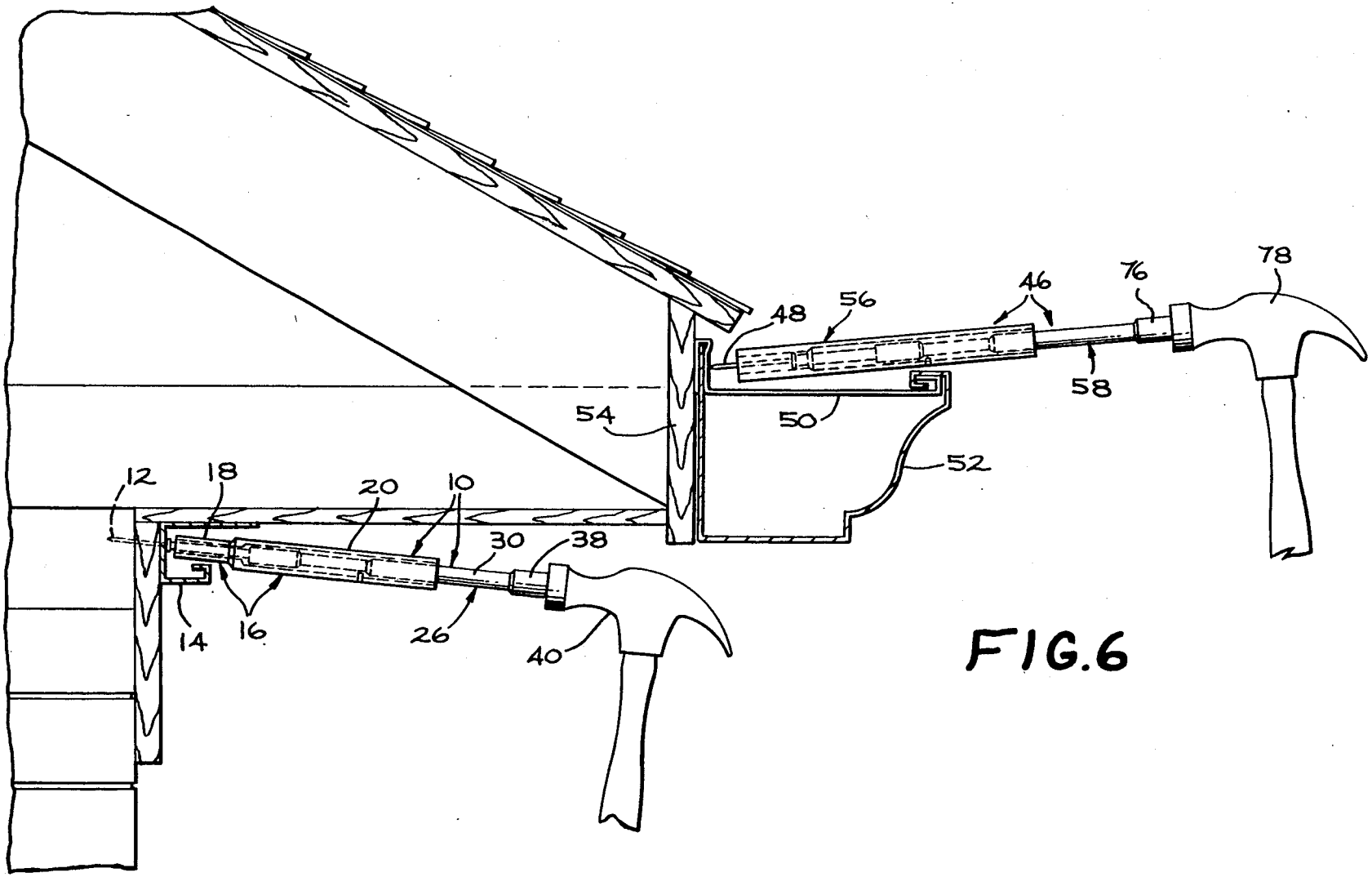
FIG. 6 shows a cross-sectional side elevation view of a fractional portion of a house and roof illustrating the use of the tool of FIGS. 1–3 to nail a piece of J-channel trim onto a roof soffet and of the tool of FIGS. 4–5 to nail a gutter hanger and gutter onto a roof facia board.

Referring now to FIGS. 1–3 and 6 there is shown, in one preferred embodiment of our invention, a nail guiding and driving tool 10 adapted for guiding and driving a relatively small nail 12 into hard to reach places such as, for example, a J-channel member 14 used for roof soffet trim. The tool 10 includes a generally cylindrically shaped metal sleeve 16, having a lesser diameter forward portion 18 and a greater diameter body portion 20 defining cylindrically shaped hollow shafts 22 and 24, respectively, and a metal nail driving member or punch 26 disposed partially within in the sleeve 16. The punch 26 is constructed of two separate and distinct elements. One of the elements is a hammer blow receiving body portion having a pair of relatively large diameter end sections 28 and 30 which closely conform to the diameter of the shaft 24 but which nevertheless slide freely therein spaced apart but joined by a relatively smaller diameter central or mid-section 32. The other element is a cylindrically shaped nail driving portion 34, a rear end portion of which is press fitted and glued or welded into a cylindrically shaped shaft 36 concentrically drilled into a forward end of the end section 28. Because the nail driving portion 34 is separate and distinct from the body portion of the punch 26, it can be heat treated prior to placement in the shaft 36 to build up its hardness to a satisfactory level. We recommend heat treating the nail driving portion 34 to a hardness of at least Rockwell 40. The punch 26 also includes a head 38 adapted for receiving direct blows from nail driving means such as a hammer 40.

The punch 26 is relatively freely slidably within the sleeve 16 between a fully advanced position as shown by the position of dashed lines in FIG. 2 as at 28', 30', 34' and 38' and a fully retracted position against a stop pin 41 as shown in FIG. 3. The fully advanced position of the punch 26 occurs when the forward end of the large diameter end section 28 comes into contact with an annular wall 42 at the position where the shafts 22 and 24 communicate. The fully retracted position of the punch 26 occurs when a rear end of the section 28 slides rearwardly against the pin 41 which is disposed and welded into a hole in the body 20 of the sleeve 12, which pin 41 projects inwardly into the shaft 24 toward the lesser diameter section 32. The pin 41 projects into the shaft 24 inwardly beyond the outer surface of the sections 28 and 30 but not so far as to engage the surface of the section 32, whereby the pin 41 acts as a stop to keep the punch 26 from sliding rearwardly out of the sleeve 16 as, for example, when the user of the tool 10, while holding onto the sleeve 16, tilts the front end of the sleeve 16 upwardly.

The tool 10 can be used to countersink the nail 12 into the wall of the J-channel member 14 by hammering the punch 26 forward against the nail 12 until the forward end of nail driving portion 34 projects forwardly beyond the frontal opening in the sleeve 16 as shown in full in FIG. 1 and by dashed lines as at 34' in FIG. 2. It is important that the pin 41 be positioned so that it remains spaced from the forward end of the section 30 when the punch 26 is in such a fully advanced position. If the forward end of the section 30 were allowed to come into contact with the pin 41, the impact of the hammer 40 upon the punch 26 would most certainly cause the inwardly projecting portion of the pin 41 to be sheared off. If countersinking of the nail 12 is not desired, the tool 10 and hammer 40 can be used to drive the nail 12 into the J-channel member 14 just so far as necessary to cause the nail head to rest flush against the metal surface as shown in FIG. 6. To drive the nail head flush, the front end of the driving portion 34 will be driven to a position approximately flush with the opening in the front end of the sleeve 16 to the position of the punch 26 as shown in full in FIG. 2. This latter position is considered to be an intermediate advanced position as compared to the fully advanced position of the punch 26 as shown in full in FIG. 1 and in phantom in FIG. 2.

Referring now to FIGS. 4–6 there is shown, in another preferred embodiment of our invention, a nail guiding and driving tool 46 adapted for guiding and driving a relatively large nail 48 into hard to reach places such as, for example, a hidden or interior gutter hanger member 50, gutter 52 and facia board 54. The tool 46 includes a hollow cylindrically shaped sleeve 56 of constant outside diameter and a nail driving member or punch 58. The sleeve 56 defines a hollow shaft therein having a smaller diameter section 60 and a larger diameter section 62 communicating with one another at an annular wall 64. The punch 58 includes a cylindrically shaped hammer blow receiving body portion 66 having a pair of spaced apart, larger diameter end sections 68 and 70 which closely fit but freely slide within the shaft section 62. The sections 68 and 70 are jointed by a lesser diameter mid-section 72. The punch 58 also includes a separate and distinct nail driving member 73 press fitted and glued into a hollow shaft which is drilled concentrically into a front position of the section 68. A stop pin 74 is disposed and welded in a hole in the side of the sleeve 56 so as to project into the shaft section 62 inwardly beyond the outer surface of the larger diameter sections 68 and 70 toward by not against the mid-section 72. As in the previous example, the stop pin 74 is positioned along the sleeve 56 so that the front end of the section 68 will move forward against the annular wall 64 to limit further forward movement of the punch 58 before the forward end of the section 70 engages the pin 74. Thus a small gap should exist between the section 70 and pin 74 when the punch 26 is at its most advanced position to prevent damage to the pin 74 which might otherwise occur in the event that the section 70 were hammered into the pin 74. The intermediate advanced position of the punch 58 is shown in full in FIG. 4 and the fully advanced position of the punch 58 is shown in the same figure in phantom by the position of the elements 68, 70, 73 and 76 when at 68', 70', 73' and 76', respectively. A partially retracted position of the punch 58 is shown in FIG. 5. The rear end of the section 68 will slide rearwardly into engagement with the pin 74 to limit rearward movement of and confine the punch 58 within the sleeve 56 when the front of the sleeve 56 is tilted upwardly. The punch 58 also includes a head 76 adapted to receive direct blows from a hammer 78.

Although the present invention has been described with respect to specific details of certain preferred embodiments thereof, it is not intended that such details limit the scope and coverage of this patent otherwise than as specifically set forth in the following claims.

I claim:

1. A nail guiding and driving tool comprising a sleeve defining a hollow shaft, said shaft having a lesser diameter forward section opening onto a front end of said sleeve from which a nail can be driven and a larger diameter rearward section opening onto a rear end of said sleeve, punch means for driving a nail from said sleeve slidably disposed partially within said shaft, said punch means being freely rotatable in said sleeve and including a body portion having a pair of relatively large diameter spaced apart end sections which closely conform to but which are freely slidable within said rearward shaft section and a relatively small diameter central section which joins said end sections concentrically, and a nail driving portion closely conforming to but freely slidable within said forward shaft section joined to the forward most end of said end sections for slidable movement of a front end of said nail driving means between a retracted position in a rear end portion of said forward shaft section and an advanced position at least flush with the opening in the front end of said sleeve, and stop means connected to said sleeve and projecting toward said central section between said end sections for limiting the rearward sliding movement of said punch means within said sleeve without touching said central section and without interferring with the forward sliding movement of said punch means in said sleeve.

2. The tool of claim 1 wherein said sleeve comprises a forward portion and a rearward portion, said forward portion being of lesser diameter than said rearward portion, said forward portion defining said forward shaft section and said rearward portion defining said rearward shaft section.

3. The tool of claim 1 wherein said sleeve is cylindrically shaped and of uniform outside diameter along its entire length.

4. The tool of claim 1 wherein said punch means also comprises a head attached to the end of the rearmost one of said end sections outside of said sleeve adapted for receiving blows thereon from a hammer.

5. The tool of claim 1 wherein said sleeve defines an annular wall at the position in said shaft at which said forward and rearward shaft sections meet, a forward end of the forwardmost one of said end sections being adapted to slide into and against said wall to limit the forward sliding movement of said punch in said sleeve.

6. The tool of claim 5 wherein said stop means is positioned along the length of said sleeve such that a space or gap exists between said stop means and a forward end of the rearmost one of said end sections when said punch is located at its forwardmost position in said sleeve to prevent damage to said stop means caused by hammering said punch thereagainst.

7. The tool of claim 5 further comprising a driving head attached to the end of the rearmost one of said end sections outside of said sleeve, said driving head being spaced from the rear end of said sleeve when said punch means is at the limit of its forward sliding movement sufficient to prevent a user's hand from being pinched between said driving head and said sleeve as said driving head is hammered toward said sleeve.

8. The tool of claim 1 wherein said stop means comprises a pin projecting toward but spaced from said central section.

9. The tool of claim 1 wherein said nail driving portion is adapted to be driven forward slidably to a position in front of and beyond the opening in the front end of said sleeve for countersinking a nail into a material into which said nail is driven by said punch.

10. The tool of claim 1 wherein the forwardmost one of said pair of end sections defines a concentrically aligned hollow bore opening onto a forward end thereof, said nail driving portion being separate and distinct from said body portion and having one end portion received in said bore, said nail driving portion being heat-treated.

* * * * *